United States Patent [19]

Romanauskas et al.

[11] 3,998,383

[45] Dec. 21, 1976

[54] GRADIENT SEPARATION APPARATUS

[75] Inventors: William A. Romanauskas, Southbury; Oakley L. Weyant, Sandy Hook, both of Conn.

[73] Assignee: E. I. Du Pont de Nemours and Company, Wilmington, Del.

[22] Filed: July 16, 1975

[21] Appl. No.: 596,233

[52] U.S. Cl. ..... 233/26

[51] Int. Cl.[2] ..... B04B 9/12

[58] Field of Search ..... 233/1 R, 1 A, 26, 27

[56] References Cited

UNITED STATES PATENTS

| | | | |
|---|---|---|---|
| 2,351,708 | 6/1944 | Rubissow | 233/26 |
| 3,071,316 | 1/1963 | Piemonte et al. | 233/26 |
| 3,265,296 | 8/1966 | Mitchell | 233/26 |
| 3,434,615 | 3/1969 | Barletta | 233/26 X |
| 3,456,876 | 7/1969 | McEwen | 233/26 |
| 3,459,369 | 8/1969 | Marks | 233/26 |

OTHER PUBLICATIONS

Beckman – Spinco Publication No. SBE–3, Analytical Ultracentrifuge, May, 1960.

Beckman Instruments Catalog, Analytical Cells, Spinco SB–189E Dec. 1973, p. 11.

*Primary Examiner*—George H. Krizmanich

[57] ABSTRACT

A centrifuge rotor has vertically oriented peripheral cavities and/or adaptors configured to receive sample containers each having a length which exceeds its diamter. Each cavity and/or adaptor is provided with a cap and/or an adaptor cap which together provide a rigid support and seal for each sample container. With this apparatus the separation gradient reorients from horizontal during separation to vertical during sample removal providing the advantages of reduced separation time and improved resolution.

12 Claims, 5 Drawing Figures

GRADIENT SEPARATION APPARATUS

CROSS REFERENCE TO OTHER APPLICATIONS

A method of gradient separation is described and claimed in an application Ser. No. 596,234, filed in the name of Vernon C. Rhode on July 16, 1975 and assigned to the same assignee as this application.

BACKGROUND OF THE INVENTION

This invention relates to a centrifuge for effecting density gradient separations and, more particularly, to centrifuge apparatus in which the sample containers are generally vertically oriented and shaped to provide gradient separations.

The field of centrifuging is a relatively old field. It is based upon the use of centrifugal force to separate particles. Such force causes the particles to move outwardly from the rotational center of the rotor towards the periphery. This is called sedimentation. The sedimentation rate is dependent upon several factors. These factors include rotational speed, the density and viscosity of the medium in which the particles are suspended, the density of the particle, and the size and shape of the particle.

Utilizing these various criteria, the particles are separated in space by the differing distances they traverse along the centrifugal force vector. The degree of separation along this force vector, often termed a separation gradient, determines the degree of resolution with which particles may be separated.

In one type of separation, known as density gradient separation, a column of liquid in which the density of the liquid varies in a known way from one end of the column to the other, is used. Thus when the particle under the influence of centrifugal force reaches the point of its isopycnic density, i.e., the density of the surrounding liquid, it will cease to migrate along the force vector in either direction.

Swinging bucket centrifuges typically are used for this purpose. A disadvantage of this type of separation is that the required separation times can be extreme, even when ultra centrifuges are used, because of the relatively long path length the particles must travel to be separated from one another. While a disadvantage in separation time, the container length is a decided advantage in recovery of the separation zones or bands. The long column provides for a relatively wide separation of the bands of particles which is a decided advantage. It would be desirable to achieve shorter separation times and yet retain the advantages of long path length during recovery.

In addition to swinging bucket rotors, zonal centrifuge rotors have been devised for density gradient separation work. One such is described in U.S. Pat. No. 3,243,105 issued Mar. 29, 1966 to Norman G. Anderson. Anderson provides a bowl type rotor in which a density gradient is established. The problems encountered with the Anderson approach are many and are based to a large extent upon the fact that the spin axis passes directly through the bowl. This means that portions of the sample must go through relatively large area changes with attendant, excessive shearing. This excessive shearing tends to disturb the separation and therefore decreases the resolution and purity of separation.

An improvement over Anderson is described in U.S. Pat. No. 3,708,111 issued Jan. 2, 1973 to Phillip Sheeler et al. There is described in Sheeler et al a reorienting gradient zonal rotor in which the rotor is a cylindrical chamber divided into a plurality of sector-shaped compartments. The floor or ceiling of the chamber defines a U-shaped annular groove to increase the path length and hence increases the separation of the bands as they are recovered. Unfortunately the separation path length is relatively long with the attendant separation time disadvantages.

Accordingly, it is an object of this invention to obviate many of the disadvantages inherent in prior art gradient separation centrifuges.

Another object of this invention is to provide an improved centrifuge apparatus for effecting gradient separations.

SUMMARY OF THE INVENTION

In accordance with a preferred embodiment of the apparatus of this invention, a centrifuge having a rotor with a vertically oriented spin axis for effecting horizontal gradient separations of a sample and reorienting the gradient for vertical gradient reorientation of the separated sample components includes a plurality of elongated sample containers each having a height which is greater than its diameter, housing means for mounting the containers circumferentially about the spin axis of the rotor with the axis of each said container generally parallel to the spin axis, each said housing means providing a rigid support for its associated said container and the container's contents against vertically directed fluid pressure forces.

In this manner the advantages of using a vertically oriented sample container for gradient separations are made possible by providing an adequate structural support for the container and cap thereby to prevent leakage which would otherwise invariably occur. In one form of the invention the cap is secured directly to the centrifuge rotor; in another, the cap is secured to an adaptor fitted in the rotor, the adaptor providing additional support for the sample container.

BRIEF DESCRIPTION OF THE DRAWINGS

Further advantages and features of this invention will become apparent upon consideration of the following description wherein.

DESCRIPTION OF THE PREFERRED EMBODIMENT

As noted hereinbefore, centrifugation theory indicates that for any given rotor speed and maximum particle radius, particle sedimentation time can be reduced by decreasing the path length over which the particles to be separated must travel. Once separation has occurred, it is difficult to recover, without some degree of inter-mixing, the several regions or bands of separated particles utilizing conventional centrifugation techniques.

Many of these disadvantages are overcome in accordance with this invention by utilizing a centrifuge having a rotor in which elongated sample tubes or containers are generally vertically oriented for rotation about a vertical spin axis. Utilizing such vertical orientation, the advantages of short path lengths (the diameter of the tubes) and hence a relatively steep gradient (density, rate, or other) during centrifugation as well as the advantages of a relatively long path length band recovery, i.e., relatively wide separation of bands are both achieved. The gradient reorients between separation and recovery to facilitate the long recovery path length as is described in the said Rohde application.

Figure 1:
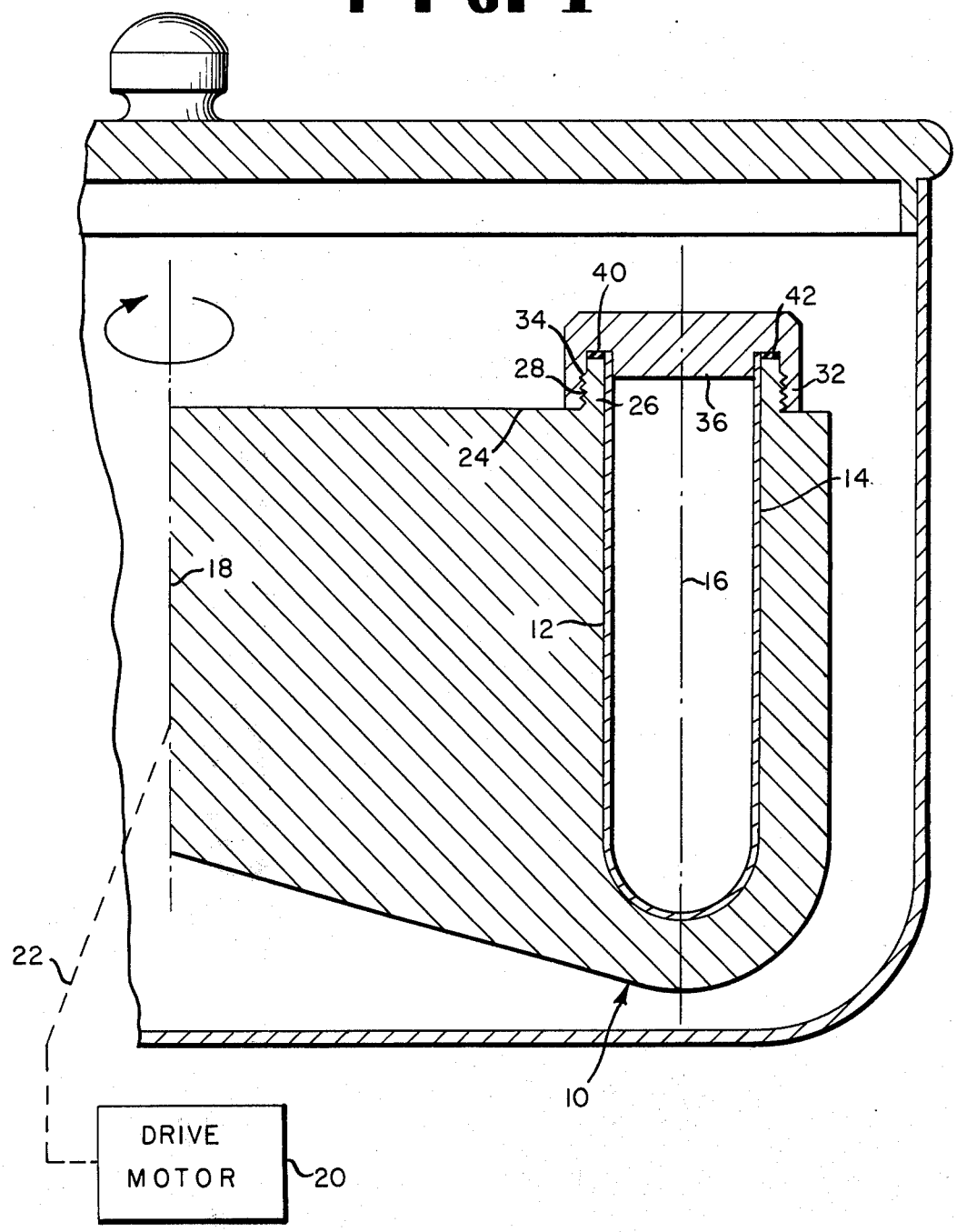
FIG. 1 is a fragmentary, cross sectional elevation view of a centrifuge rotor, partly in schematic, for a vertically oriented sample container and structured to permit reorienting gradient separations constructed in accordance with one embodiment of this invention.

Apparatus for achieving these ends is illustrated in the several figures of which reference initially is made to FIG. 1. In this figure there is seen in fragmentary view a rotor 10 which provides a housing and envelope type support for a plurality of circumferentially spaced sample containers 12 (only one being shown for sake of clarity). Each sample container or tube 12 is elongated and is adapted to be vertically inserted into a cavity 14 with a sliding fit. The cavity 14 preferably has a vertical axis 16 which is generally parallel to and, when the rotor rotates, spins about the vertically oriented spin axis 18. The rotor is adapted to be driven by a drive motor 20 of conventional type which acts through a conventional linkage denoted by the dashed line 22.

Further in accordance with this invention the upper surface 24 of the rotor 10 has an upwardly extending annular lip portion 26 which is co-extensive with the mouth or opening of the cavity 14 and extends above the upper surface 24 of the rotor. The exterior of the lip portion 26 is provided with threads 28. A cap 30 has a downwardly extending annular skirt portion 32 the interior of which is also threaded as at 34 to engage the lip threads 28. The interior portion of the rotor cap 30 has a downwardly extending stem or plug 36 which forms a close sliding fit with the interior of the sample container 12 so as to form an annular groove 40 within the cap which fits over the lip portion 26. In the region between the upper surface of the lip 26 and the annular ring 40 there is provided a suitable seal such as a washer or an O-ring 42. It is thus seen that the vertically oriented sample container, which typically may be of a suitable plastic such as that typically used for centrifuge tubes, supported by the rigid envelope housing formed by the rotor and cap, is capable of horizontal gradient separations. The structural rigidity, provided by the rotor body as well as by the rotor cap, resists the extreme upwardly, vertically directed pressure forces which normally occur during centrifugation.

Figure 2:
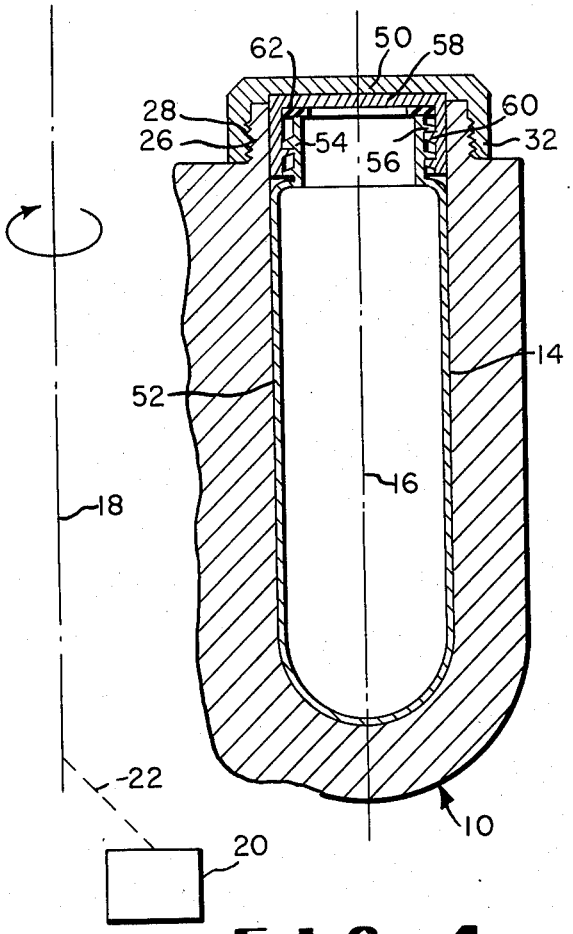
FIG. 2 is a fragmentary, cross sectional, side elevation view of a centrifuge rotor constructed in accordance with still another embodiment of this invention.

An alternative embodiment of the invention, is illustrated in FIG. 2, in which all of the parts are essentially the same as described in the preceding embodiment with the exception that the sample container 52 is provided with a reduced diameter opening or mouth 54, the exterior of which is threaded as at 56. These threads accommodate a sample container cap 58 the interior walls of which are threaded as at 60 such that the cap may be screwed over the open mouth 54. A suitable washer type seal 62 is provided in the cap to prevent fluid leakage. The cap may be formed of the same material as the container.

In this embodiment, the rotor cap 50 omits the downwardly extending stem or plug portion 36 such that the container cap can be accommodated within the cavity formed in the cap. Otherwise its function is the same, namely, to provide sufficient structural strength to the container and its cap to resist the upward, vertically oriented forces which exists during centrifugation with the vertically oriented containers.

Figure 3:
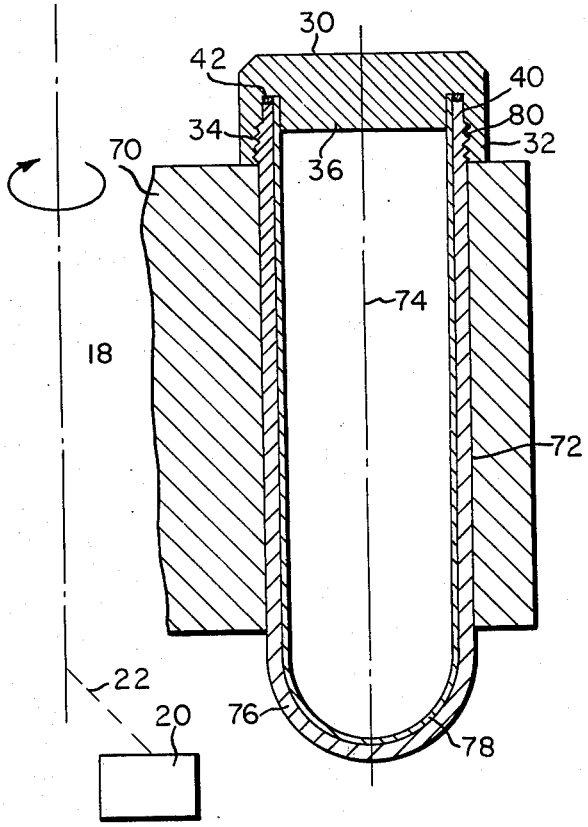
FIG. 3 is a fragmentary side elevation view, in cross section, of a centrifuge rotor utilizing an adaptor constructed in accordance with another embodiment of this invention.

Still another embodiment of the invention is depicted in FIG. 3 in which a rotor body 70 is adapted to spin about a vertical axis 18 using the drive means 20 operating through a linkage 22. In this instance however the rotor body 70 is provided with a bore 72, extending through the rotor from top to bottom and having a vertical axis 74. A tubular adaptor 76 is inserted into this bore 72 preferably with a sliding fit. The adaptor may be made of aluminum or other suitable light weight metal so as to provide suitable structural strength to support a sample container 78 which is adapted to fit within the adaptor 76. The upper portion of the adaptor 76 is threaded as at 80. The lower portion of the threads prevent the adaptor from sliding down through the bore. Alternatively, an annular flange (not shown), may be used. In this instance the cap 30 is substantially the same as that described in conjunction with the embodiment in FIG. 1. The cap 30 has internal threads 34 within the downwardly extending skirt portion 32 and has a downwardly extending plug or stem 36 which provides a sliding fit within the container. The stem 36 acting together with the downwardly extending skirt portion 32 together define an annular groove 40, the upper portion of which is adapted to hold a suitable seal such as O-ring 42, adapted to engage the upper portion of the adaptor 76 and the sample container 78 to prevent leakage from the container.

It is thus seen that the adaptor 76 together with the adaptor cap 30 provides sufficient structural strength for the container and its cap to withstand the vertically oriented forces occurring during centrifugation as previously described.

Figure 4:
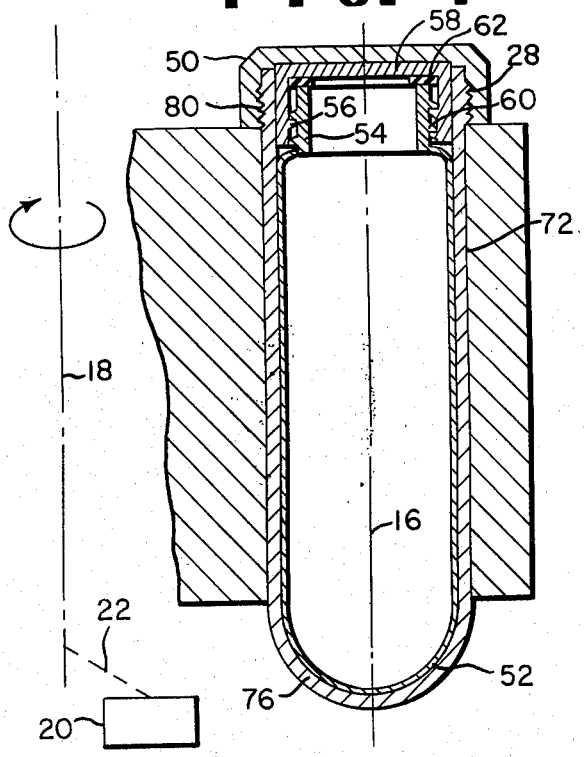
FIG. 4 is a fragmentary, cross sectional, elevation view of a centrifuge rotor utilizing an adaptor constructed in accordance with still another embodiment of this invention.

Still another alternative embodiment is illustrated in FIG. 4. In this instance however the sample container 52 is modified to have a structure actually the same as a portion of that depicted in the embodiment of FIG. 2 with the container and its cap enclosed within an adaptor rather than directly within the rotor cavity. Thus the sample container 52 is provided with a sample container cap 58 whose interior threads 56 are adapted to engage threads 28 on the mouth of the adaptor, the sample container 52 having a reduced diameter mouth portion 54 as in the embodiment of FIG. 2. The adaptor cap 50 omits the stem portion as shown in FIG. 3. A suitable annular seal 62 prevents leakage about the container cap. Here again the structural strength to resist the vertically oriented forces during centrifugation is provided by the adaptor 72 and the adaptor cap 50 rather than being left to the container alone as is generally done in the prior art. The threads 80 prevent the adaptors slipping through the cavity 72.

Figure 5:
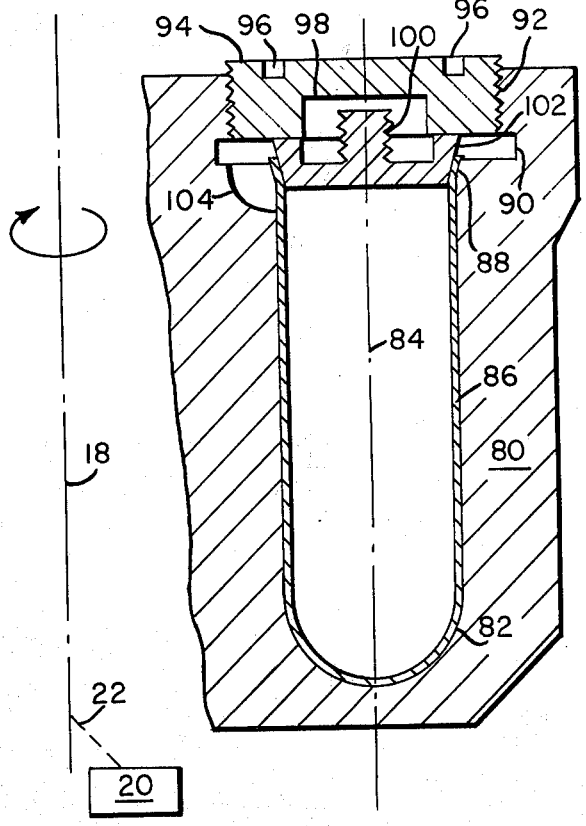
FIG. 5 is a fragmentary side elevation view, in cross section, of a centrifuge rotor adapted to hold a sample container constructed in accordance with another embodiment of this invention.

A further embodiment of the invention is depicted in FIG. 5 in which a rotor 80, constructed of conventional material, is formed with circumferentially positioned cavities 82. Each of the cavities 82 may be seen to be elongated and formed to have a vertical axis 84 adapted to revolve about and parallel to the vertically oriented spin axis 18 of the rotor as previously described, i.e., the cavities are radially spaced from the spin axis. The rotor is driven, also as previously described, by the drive means 20 through a suitable linkage 22.

In this embodiment the sample container 86 is constructed of a relatively thin plastic material similar to that described previously (FIG. 1). The mouth portion 88 of the cavity is flared and opens into an annular groove 90. The lip 92 of the cavity is of somewhat reduced diameter and internally threaded to accommodate an externally threaded plug or cap 94. Spanner holes 96 are provided in the cap to facilitate its removal. A central axial recess 98 is formed on the lower face of the cap 94 to accommodate the threaded stem 100 of a tapered sealing plug 102. The sealing plug 102 is configured to engage and compress the upper end of the inner walls of the sample tube 86 against the flared portions 88 of the cavity, thereby to provide a seal for the tube's contents. In a preferred embodiment, the angle of the taper equals the angle of the flare, both angles being measured relative to the axis 84, although the taper may if desired be less than the flare. A 15° taper angle is preferred although angles in the range of 0–30° may be used so long as the taper angle is less than or equal to the flare angle. A small side cavity 104 is formed contiguous cavity 82 in the region of the flare along a radius of the rotor radially inside of the cavity radius as illustrated. This breaks the seal's continuity for venting purposes and easier removal of the tube. Thus when the containers are filled, the small remaining air gap at the top has a place to vent when sealing the container. Further when the horizontal gradient is established, the cavity 104 is in direct alignment therewith so there is no fluid leakage. The same cavity may be used to advantage in the other embodiments.

It may be seen from the drawings that all of these various configurations provide a housing for the containers which is independent of the container and is not required to be attached to the container such as by threads. The housing thus provides a rigid support for the container in all directions.

There is then thus described various apparatus capable of effecting horizontal gradient reorienting separations each of which are directed to the purpose of providing a vertical orientation of the various containers as they spin about a spin axis. In addition, the rotor and/or adaptor provides the additional structural strength required to prevent leakage of the fluid contents of the sample containers.

This apparatus is seen to achieve the advantages of a short path length and a relatively steep gradient during centrifugation and yet takes advantage of a long path length during band recovery. The long path length during recovery, as previously noted, provides a relatively wide separation of bands and reduces their intermixing during recovery. This improves the resolution obtainable.

We claim:

1. A centrifuge having a rotor with a vertically oriented spin axis for effecting horizontal gradient separations of a sample and vertical gradient reorientation of the separated sample components comprising, in combination:

a plurality of elongated sample containers, housing means for mounting said containers about the spin axis of said rotor with the axis of each said container generally parallel to said spin axis, each said housing means being independent of said container and completely enclosing and providing a rigid support in all directions for a different said container particularly against vertically directed fluid pressure forces.

2. A centrifuge according to claim 1 wherein said housing means includes:

said rotor which defines a separate cavity for each said container, an upwardly extending annular lip at the opening of each cavity integral with said rotor, and a rotor cap secured to said lip thereby to completely enclose each said cavity and support each said container.

3. A centrifuge according to claim 2 wherein each said container has a separate cap which seals said container and is supported by said rotor cap.

4. A centrifuge according to claim 2 wherein each said rotor cap includes an annular interior groove, and an annular seal in said groove adapted to engage said lip.

5. A centrifuge according to claim 1 wherein said housing means defines circumferentially spaced, vertically oriented bores in said rotor, one for each said container, and includes a rigid adaptor, each completely enclosing and sealing a different said container, seated in each said bore.

6. A centrifuge according to claim 5 wherein each said container has an associated container cap which seals said container and is structurally supported by said adaptor.

7. A centrifuge according to claim 5 wherein each said adaptor has a cap threaded engaged thereto which rigidly encloses and supports said container.

8. A centrifuge according to claim 1 wherein said housing means includes:

said rotor which defines a separate cavity having an open upper end for each said container, an internal lip at the open end of each said cavity, a sealing plug in the open end of each said sample container, a rigid plug secured to the internal lip of each said cavity to hold said sealing plug in sealing relationship with said container.

9. A centrifuge rotor for centrifuging an elongated sample container having an open end comprising in combination:

a rotor having a vertically oriented rotational axis and defining a radially spaced, elongated cavity having a longitudinal axis generally parallel to said rotational axis, said cavity rigidly supporting said container and having an open end, a first cap sealing said open container end, a second cap secured to the open end of said cavity rigidly supporting said first cap.

10. A centrifuge rotor according to claim 9 wherein said second cap fits in said open cavity end.

11. A centrifuge rotor according to claim 10 wherein a portion of the open end of said cavity is flared and said first cap is tapered to press the open end of said container between said cap and said flare.

12. A centrifuge rotor having a rotational axis, at least a single radially spaced elongated cavity defined by a bore closed at one end and a lip or counterbore each having a common axis substantially parallel to said rotational axis, said cavity adapted to rigidly support an open ended container, a first plug fitted in the open end of said bore for sealing the open end of a container, and a second plug secured in said counterbore for rigidly supporting said first plug and a container against axial movement.

* * * * *